US005881426A

United States Patent [19]

Tong

[11] Patent Number: 5,881,426

[45] Date of Patent: Mar. 16, 1999

[54] BRUSH WITH FLEXIBLE BRISTLES

[76] Inventor: Gary S. Tong, 30A Heritage Hills, Somers, N.Y. 10589

[21] Appl. No.: 802,450

[22] Filed: Feb. 18, 1997

[51] Int. Cl.[6] ..... A46B 9/04; A46B 9/02

[52] U.S. Cl. ..... 15/201; 15/167.1; 15/207.2

[58] Field of Search ..... 15/167.1, 201, 15/207.2, DIG. 5

[56] References Cited

U.S. PATENT DOCUMENTS

| | | | |
|---|---|---|---|
| 3,087,223 | 4/1963 | Raw | 15/207.2 |
| 3,100,309 | 8/1963 | Gambino | 15/167.1 |
| 3,230,561 | 1/1966 | Taccone | 15/207.2 |
| 3,771,189 | 11/1973 | Horton | 15/207.2 |
| 4,381,325 | 4/1983 | Masuda | 15/DIG. 5 |
| 4,504,998 | 3/1985 | Price | 15/207.2 |
| 4,616,374 | 10/1986 | Novogrodsky | 15/207.2 |
| 5,027,463 | 7/1991 | Daub | 15/167.1 |
| 5,191,670 | 3/1993 | Lake | 15/207.2 |
| 5,325,560 | 7/1994 | Pavone | 15/201 |

FOREIGN PATENT DOCUMENTS

| | | | |
|---|---|---|---|
| 0504893 | 9/1992 | European Pat. Off. | 15/201 |
| 2614189 | 10/1988 | France | 15/167.1 |
| 2140674 | 12/1984 | United Kingdom | 15/207.2 |

*Primary Examiner*—Randall E. Chin
*Attorney, Agent, or Firm*—Patrick J. Walsh

[57] ABSTRACT

A brush with flexible bristles in which each bristle includes a flexion integral with the bristle to provide innate resilience to the bristle for flexing along its longitudinal axis. The brush fitted with the bristles includes a perforated brushhead for passing the bristles so as to maintain the bristles on their axis. A trapezoidal bristle grid provides for bristle density in the brush comparable the standard brush density.

15 Claims, 2 Drawing Sheets

BRUSH WITH FLEXIBLE BRISTLES

BACKGROUND OF THE INVENTION

The present invention relates to brushes and particularly to brushes with flexible bristles, that is, bristles that flex along their longitudinal axis.

In conventional brush construction, bristles are anchored at their lower tips in a brush base. When scrubbing pressure is applied to the upper tips, the bristles tend to deflect off their axis with consequent loss of scrubbing effectiveness. To compensate, bristles are made stiffer for maintaining scrubbing effectiveness. Stiff bristles are suitable for flat surfaces and when the surface is convex only a portion of the bristles in the overall brush length make contact with the surface. In the case of a toothbrush, bristle contact occurs at the high points of teeth contour and the intermediate recesses or hollows remain unbrushed.

There is need for a brush with bristles that flex longitudinally, that is, undergo an effective or virtual decrease in the height of the bristle, so that the brush over its entire length of bristles remains in contact with curved surfaces such as a toothbrush for brushing teeth.

SUMMARY OF THE INVENTION

The present invention provides a brush with bristles or tufts of bristles that flex along the longitudinal axis of the bristle.

In a preferred embodiment of the invention, an elongate bristle has its lower tip embedded in a brush base, with an intermediate section of the bristle above the base being bent or flexed with respect to the longitudinal axis, and with the upper portion of the bristle lying along the axis normal to the base. The result is a bristle resilient to downward pressure applied at the upper tip, with the bristle compressing along its axis. A set of bristles compresses in conformity with a convex surface so that a toothbrush contacts both high and hollow surfaces of teeth. The innate resilience of the bristles permits design of a brush with tufts that can change in effective height thereby conforming to variations in the surface contour of the brushed object.

Several embodiments of compressible or flexible bristles and tufts of bristles are disclosed.

In another aspect of the invention, a brush with flexible bristles comprises a base for receiving a plurality of bristles and a perforated brushhead overlying the base and together with the base defining a cavity for enclosing the lower portion of the bristles including their flexed sections. The brushhead is perforated with apertures through which the bristles project and with the apertures maintaining the bristles normal to the base as the bristles flex along their longitudinal axis.

In another aspect of brush design, bristle tufts are distributed on the base in a trapezoidal pattern to provide the added space necessary for proper flexing of tufts when brushing. The trapezoidal pattern of tufts gives a tuft density comparable to that in standard brushes, toothbrushes for example.

A brush with bristles or tufts of bristles according to the invention follows a convex row (teeth) within the practical limits of bristle flexing. Along the brush length, conformity may be larger or smaller depending on the curvature of the teeth in a particular section of the row of teeth. Conformity also varies with the excursion of the bristles, i.e., the limits of longitudinal movement of bristle when pressure is applied to its upper tip. So, the greater the excursion, the greater is the conformity range along the length of the brush. In any case, conformity is significant for a single tooth or several teeth along a shorter range of the total length of the brush.

A brush according to the invention uses standard brush materials with little or no increase to the height of the brush measured from base to bristle tips.

OBJECTS OF THE INVENTION

An object of the invention is to provide a brush with bristles that readily conform to curved surfaces.

Another object of the invention is to provide a brush with bristles or tufts of bristles each having a flex section accommodating compression of the bristles along their long axis so that a section of bristles conforms to curved surfaces.

Another object of the invention is to provide a brush with flexible bristles and a brush head with apertures for maintaining bristles normal to the brush base as the bristles flex.

Another object of the invention is to provide a brush with flexible bristles arranged in a trapezoidal pattern in the brush base to allow for bristle flexing and a bristle density comparable to standard brush design.

Another object of the invention is to provide a toothbrush with flexible bristles for greater contact by the bristle tips with the irregular surface of a row of teeth.

Other and further objects of the invention will become apparent with an understanding of the following detailed description of the invention or upon employment of the invention in practice.

A preferred embodiment of the invention has been chosen for purposes of detailed description and is shown in the accompanying drawing in which:

DETAILED DESCRIPTION OF THE PREFERRED EMBODIMENT

Figure 1:
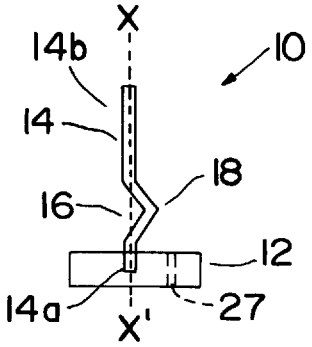
FIG. 1 is a schematic view of a flexible bristle embedded in a base according to the invention.

Referring to the drawing, FIG. 1 illustrates a segment of a brush 10 according to the invention including a base 12, and an elongate bristle 14 anchored at its lower tip 14*a* in the base. The bristle projects upwardly from the base along a longitudinal axis x—x' normal to the base. The bristle includes a flexion 16 in the form of a bent or oblique section that yields or flexes like a knee,18 when pressure is applied to the upper tip 14*b* of the bristle.

Figure 2:
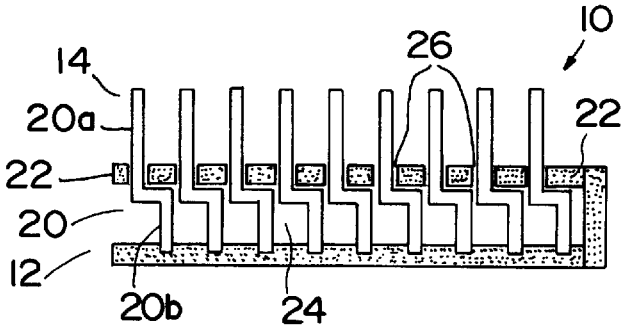
FIG. 2 is a schematic view of a brush with flexible bristles according to the invention.

A brush 10 fitted with bristles 14 according to the invention is shown in FIG. 2 and includes a base 12 for anchoring bristles or tufts of bristles projecting upwardly. A modified bristle includes a perpendicular flexion or knee 20 lying generally horizontally between upper 20*a* and lower 20*b* portions of the bristle. A brushhead 22 overlies the base and together with the base defines a cavity 24 enclosing the flexion portion of the bristle. Each bristle passes through an aperture 26 in the brushhead so that the brushhead keeps the bristle aligned along its axis enabling the bristle to move vertically to the limits of its design excursion.

If desired, one or more drain ports 27 ( FIG. 1) may be located in the brush as for example in base 12 to provide for draining and drying of the cavity.

Several modified embodiments of bristle are shown in FIGS. 3*a–d*.

In Figure, 3*a*, a brush as described in FIG. 2 is fitted with a bristle 14 having an arcuate flexion 28 in the form of a segment of a circle. The flexion acts as a spring and flexes when pressure is applied at tip 14*b*.

Figure 3A:
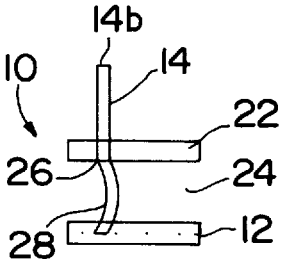
FIGS. 3*a–d* are schematic views of flexible bristles with particular types of flexions.
Figure 3B:
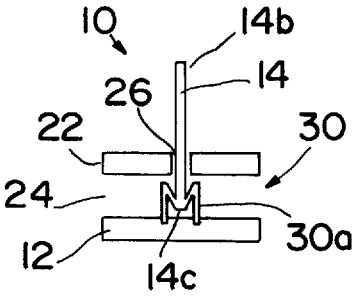
Figures 1, 3B:
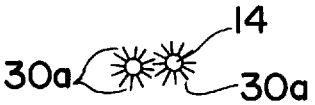

FIG. 3*b* illustrates a bristle 14 with one form of concentric flexion. The flexion 30 comprises a plurality of legs 30*a* bent at an acute angle interconnecting the bottom 14*c* of the bristle and the base 12 of the brush 10. The legs 30*a* are positioned radially of the bristle body as seen in FIG. 3*b'*. The legs provide flex for the bristle when pressure is applied to its tip 14*b*. It is also to be observed in FIG. 3*b'* that the interlocking of legs reduces intertuft distance for achieving greater bristle density.

Figure 3C:
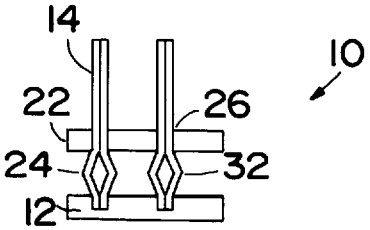

Another type of concentric flexion is shown in FIG. 3*c* and includes a pair of oblique flexions or knees 32 opening outwardly form each other to provide flex.

Figure 3D:
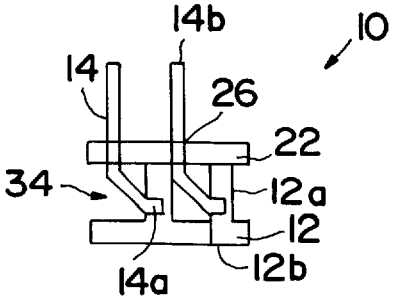

An offset flexion 34 is illustrated in FIG. 3*d* wherein the base 12 includes integral posts 12*a* with horizontally opening bores 12*b* receiving the lower bristle tips 14*a*. The canted flexion 34 carries an upwardly extending bristle 14 projecting through one of the brushhead apertures 26. The offset flexion accommodates vertical excursion of the bristle when pressure is applied to the tip 14*b*.

Figure 4A:
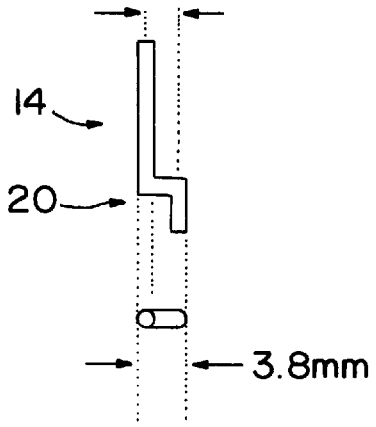
FIGS. 4*a–c* are schematic detail views of bristle tuft spacing on a trapezoidal pattern.
Figure 4B:
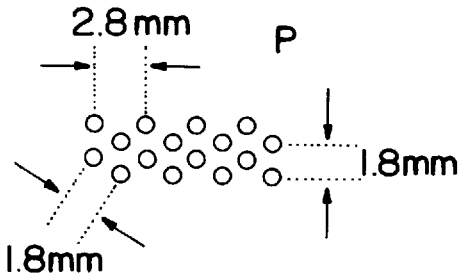
Figure 4C:
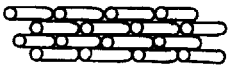

In a brush according to the invention, bristles are arranged in a trapezoidal grid to achieve to space required for flexing and to provide a bristle density comparable to standard brush design. As shown in FIG. 4*a–c*, a bristle 14 with perpendicular flexion 20 has a width of 3.8 mm (FIG. 4*a*). The trapezoidal pattern P for spacing of the bristles in a base appears in FIG. 4*b* with horizontal center-to-center spacing of 2.8 mm; vertical center spacing of 1.8 mm; and diagonal spacing of 1.8 mm. This arrangement gives a distribution or density of bristles as shown in FIG. 4*c*.

Figure 5:
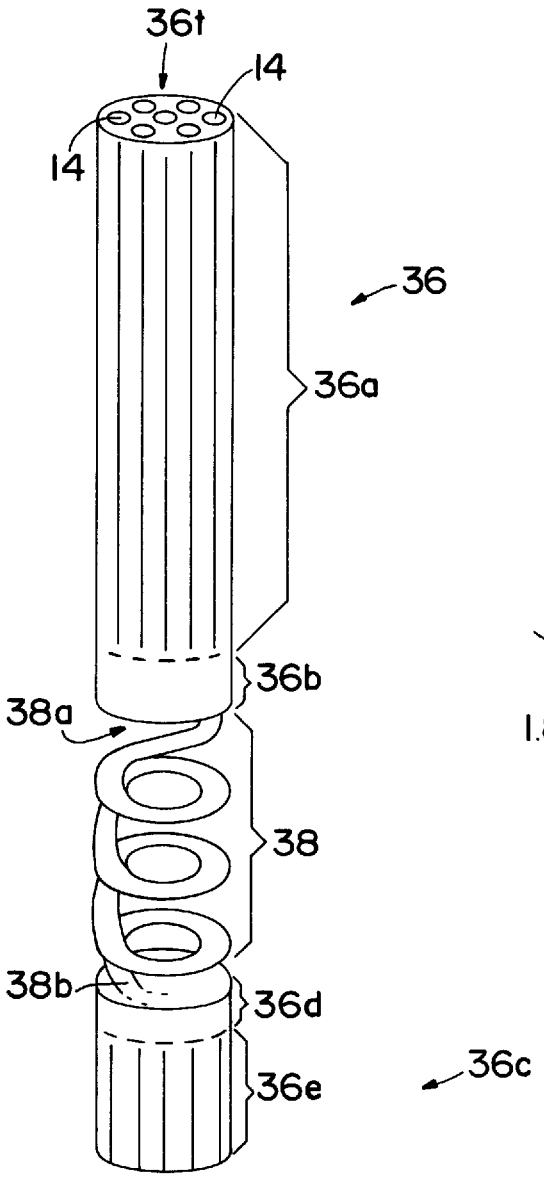
FIG. 5 is an enlarged perspective view of a flexible tuft of bristle according to the invention.

A tuft of bristles 36 is illustrated in FIG. 5 comprising an upper section 36*a* of a bundle, of individual, discrete strands or bristles 14 free at their upper ends and joined as by fusing at an intermediate section 36*b*. A lower, shorter section 36*c* of the tuft includes a bundle of bristles including a fused section 36*d* and discrete bristles 36*e*. If desired discrete bristles 36*e* may be fused. The upper and lower bundles of strands are joined by a helical compression spring 38 serving as a flexion to accommodate vertical movement of the tuft of bristles when pressure is applied to the tip 36*f*. The ends 38*a–b* of the spring are affixed or fused to the fused sections. A flat or arcuate spring may be used in place of the helical spring.

A brush with flexible bristles according to the invention has many applications and is particularly suited for toothbrushes. Reference in the specification to toothbrushes is intended in an illustrative sense.

Various changes may be made to the structure embodying the principles of the invention. The foregoing embodiments are set forth in an illustrative and not in a limiting sense. The scope of the invention is defined by the claims appended hereto.

I claim:

1. A brush comprising a base, a plurality of bristles having upper tips and lower tips, the lower tips fitted to the base with the bristles positioned along an axis generally normal to the base, each bristle having an integral flexion providing the bristle with innate resilience enabling the bristle to flex along its longitudinal axis when pressure is applied to the upper tip of the bristle, a brushhead perforated with a plurality of apertures overlying the base, and a bristle passing through each of the apertures enabling the brushhead to maintain orientation of each bristle along its axis.

2. A brush as defined in claim 1 in which each bristle flexion is perpendicular to the bristle axis.

3. A brush as defined in claim 1 in which each bristle flexion is offset to the bristle axis.

4. A brush as defined in claim 1 in which each bristle includes a plurality of legs arranged radially of the bristle to provide flexion concentric to the bristle axis.

5. A brush as defined in claim 1 in which each bristle flexion is arcuate.

6. A brush as defined in claim 1 in which the bristles are arranged in a trapezoidal pattern on the base.

7. A brush comprising a base, a plurality of tufts of bristles having upper tips and lower tips, the lower tips fitted to the base with the tufts of bristles positioned along a longitudinal axis generally normal to the base, each tuft of bristles having an upper section of a bundle of discrete bristles, a lower section of a bundle of bristles including the lower tips, and an integral flexion intermediate the upper section and the lower section providing the tuft of bristles with innate resilience enabling the tuft bristles to flex along its longitudinal axis when pressure is applied to the upper tips, a brushhead perforated with a plurality of apertures overlying the base, and a tuft of bristles passing through each of the apertures enabling the brushhead to maintain orientation of each tuft of bristles along its axis.

8. A set of bristles for a brush, each bristle having a longitudinal axis, an upper tip and a lower tip, the upper tip and lower tip of each bristle being co-linear along the longitudinal axis, the brush having a base, each bristle attached to the base with the bristle longitudinal axis normal to the base, each bristle having an integral flexion positioned intermediate the upper tip and the lower tip, the flexion being in the form of a bent section for providing the bristle with innate resilience enabling the bristle to flex along the longitudinal axis for an effective decrease in height of the bristle when pressure is applied to the upper tip of the bristle thereby enabling a set of bristles to conform to a convex surface.

9. A bristle as defined in claim 8 in which the bristle includes a plurality of legs arranged radially of the bristle to provide flexion concentric to the bristle axis.

10. A brush comprising a base, a plurality of bristles having upper tips and lower tips, the lower tips fitted to the base with the bristles positioned along an axis generally normal to the base, each bristle having an integral flexion providing the bristle with innate resilience enabling the bristle to flex along its longitudinal axis when pressure is applied to the upper tip of the bristle, each bristle flexion being offset to the bristle axis, a brushhead perforated with a plurality of apertures overlying the base, a bristle passing through each of the apertures enabling the brushhead to maintain orientation of each bristle along its axis, the base being fitted with a plurality of posts having horizontally disposed bores, and the lower bristle tips being received in said bores.

11. A brush comprising a base, a plurality of bristles having upper tips, the lower tips fitted to the base with the bristles positioned along an axis generally normal to the base, each bristle having an integral flexion providing the bristle with innate resilience enabling the bristle to flex along its longitudinal axis when pressure is applied to the upper tip of the bristle, a brushhead perforated with a plurality of apertures overlying the base, a bristle passing through each of the aperture enabling the brushhead to maintain orientation of each bristle along its axis, and the bristles being arranged in a trapezoidal pattern on the base.

12. A bristle for a brush, the bristle having a longitudinal axis, an upper tip and a lower tip, the bristle having an integral flexion positioned intermediate the upper tip and the lower tip for providing the bristle with innate resilience, the flexion being perpendicular to the bristle axis enabling the bristle to flex along the longitudinal axis for an effective decrease in height of the bristle when pressure is applied to the upper tip of the bristle.

13. A bristle for a brush, the bristle having a longitudinal axis, an upper end and a lower end, the bristle having an integral flexion in the form of a plurality of legs arranged radially of the bristle to provide flexion concentric to the bristle axis, the flexion being positioned intermediate the upper end and the lower end for providing the bristle with innate resilience enabling the bristle to flex along the longitudinal axis for an effective decrease in height of the bristle when pressure is applied to the upper end of the bristle.

14. A set of bristles for a brush, each bristle having a longitudinal axis, an upper tip and a lower tip, the upper tip and lower tip of each bristle being co-linear along the longitudinal axis, the brush having a base, each bristle attached to the base with the bristle longitudinal axis normal to the base, the bristle having an integral flexion positioned intermediate the upper tip and the lower tip, the flexion being arcuate in form for providing the bristle with innate resilience enabling the bristle to flex along the longitudinal axis for an effective decrease in height of the bristle when pressure is applied to the upper tip of the bristle thereby enabling a set of bristles to conform to a convex surface.

15. A set of bristles for a brush, the brush having a base with the base having a plurality of integral posts, each bristle having a longitudinal axis, an upper tip and a lower tip, the upper tip aligned along the longitudinal axis, the lower tip being attached to an integral post along an axis perpendicular to the longitudinal axis, each bristle haivng an inetegral flexion positioned intermediate the upper tip and the lower tip, the flexion being in the form of a canted section for providing the bristle with innate resilience enabling the bristle to flex along the longitudinal axis for an effective decrease in height of the bristle when pressure is applied to the upper tip of the bristle thereby enabling a set of bristles to conform to a convex surface.

* * * * *